US012029328B1

(12) United States Patent
McDaniel

(10) Patent No.: US 12,029,328 B1
(45) Date of Patent: Jul. 9, 2024

(54) CHAIR COVER AND ARTICLE OF CLOTHING

(71) Applicant: Christopher McDaniel, Fort Washington, MD (US)

(72) Inventor: Christopher McDaniel, Fort Washington, MD (US)

( * ) Notice: Subject to any disclaimer, the term of this patent is extended or adjusted under 35 U.S.C. 154(b) by 179 days.

(21) Appl. No.: 17/669,860

(22) Filed: Feb. 11, 2022

Related U.S. Application Data

(60) Provisional application No. 63/155,429, filed on Mar. 2, 2021.

(51) Int. Cl.

| | |
|---|---|
| ***A47C 1/10*** | (2006.01) |
| ***A47C 7/62*** | (2006.01) |
| ***A47C 7/72*** | (2006.01) |
| ***A47C 31/00*** | (2006.01) |
| ***A47C 31/11*** | (2006.01) |
| *A47C 1/04* | (2006.01) |

(52) U.S. Cl.
CPC ..... *A47C 31/11* (2013.01); *A47C 7/622* (2018.08); *A47C 7/723* (2018.08); *A47C 7/725* (2013.01); *A47C 31/007* (2013.01); *A47C 1/04* (2013.01)

(58) Field of Classification Search
CPC ..... A47C 1/11; A47C 31/11; A47C 7/622; A47C 1/04; B60N 2/58; B60N 2/60
See application file for complete search history.

(56) References Cited

U.S. PATENT DOCUMENTS

| | | | | |
|---|---|---|---|---|
| 1,261,575 A | | 4/1918 | McLeod | |
| 1,732,878 A | | 10/1929 | Collender | |
| 1,820,104 A | | 8/1931 | Whaley | |
| 4,669,778 A | | 6/1987 | Rogers, Jr. | |
| 4,946,221 A | | 8/1990 | Livingston | |
| 5,156,441 A | | 10/1992 | Byersmith et al. | |
| 5,664,832 A | | 9/1997 | Stevens et al. | |
| 5,707,107 A | * | 1/1998 | Melone | B60N 2/6027 297/229 |
| D465,688 S | | 11/2002 | Hetherington | |
| 6,709,055 B2 | | 3/2004 | Gengler et al. | |
| 7,959,227 B2 | * | 6/2011 | Miller | A47C 31/11 297/229 |

(Continued)

FOREIGN PATENT DOCUMENTS

JP 2006136593 A 6/2006

OTHER PUBLICATIONS

Espacenet English Abstract for JP2006136593 A, Jun. 1, 2006.

(Continued)

*Primary Examiner* — Syed A Islam

(74) *Attorney, Agent, or Firm* — CAHN & SAMUELS, LLP

(57) ABSTRACT

A chair cover includes a back panel configured to fit or cover a backside of a chair; a top or seat panel configured to fit or cover a front and seat area of the chair; and two side panels, each side panel configured to substantially cover an opposing side of the chair. A first fastener extends at least partially along a portion of the chair corresponding to a top or headrest of the chair. Two second fasteners each extend at least partially along a portion of the chair cover corresponding to an armrest of the chair. Each panel includes a flexible or elastic fabric, and the chair cover is configured to prevent a person from sitting in the chair.

21 Claims, 14 Drawing Sheets

(56) References Cited

U.S. PATENT DOCUMENTS

| | | | | |
|---|---|---|---|---|
| 8,678,418 | B1 * | 3/2014 | Quarles | A61G 5/1043 280/304.1 |
| 9,155,397 | B2 | 10/2015 | D'Amato et al. | |
| 9,433,245 | B2 * | 9/2016 | Elsmo | A41D 3/08 |
| 10,856,669 | B2 * | 12/2020 | Lin | A47C 31/113 |
| 2005/0120452 | A1 * | 6/2005 | Cominsky | A41D 13/11 2/9 |
| 2008/0060109 | A1 | 3/2008 | Ottah et al. | |
| 2012/0118451 | A1 | 5/2012 | Berning et al. | |
| 2013/0220877 | A1 | 8/2013 | Stern | |
| 2015/0102645 | A1 * | 4/2015 | Rogan | B60N 2/6063 297/229 |
| 2015/0265064 | A1 | 9/2015 | Vigano et al. | |
| 2016/0316931 | A1 * | 11/2016 | Trevino | A47C 31/113 |
| 2020/0128969 | A1 * | 4/2020 | Strasser | A47C 1/11 |
| 2020/0158969 | A1 | 5/2020 | Leigh et al. | |
| 2020/0202261 | A1 * | 6/2020 | Bidewell | G06Q 10/02 |
| 2020/0329883 | A1 * | 10/2020 | Jaikaransingh | A47C 31/10 |

OTHER PUBLICATIONS

Fengtaike Waterproof Barber Chair Cover, posted Sep. 26, 2018 [online], [retrived Apr. 19, 2023]. Retrieved from internet, https://www.amazon.com/FENGTAIKE-Waterproof-Stacking-Parkland-Furniture/dp/B07HNWGSGQ/ (Year: 2018).

Fengtaike Waterproof Barber Chair, posted Sep. 26, 2018 [online], [retrieved Apr. 19, 2023] retrieved from https://www.amazon.com/FENGTAIKE-Waterproof-Stacking-Parkland-Furniture/db/B07HNWGSGQ/ (Year: 2018).

* cited by examiner

CHAIR COVER AND ARTICLE OF CLOTHING

This U.S. patent application claims priority to U.S. Ser. No. 63/155,429 filed on Mar. 2, 2021, the entirety of which is incorporated herein by reference.

FIELD OF THE INVENTION

The present invention is directed to a chair cover for use with chairs, particularly service chairs typically found in barbershops, salons, shoe shine parlors, tattoo parlors, dental offices, and the like. The chair cover may also be used as an article of clothing, for example, as a smock or other protective garment.

BACKGROUND AND SUMMARY OF INVENTION

A service chair is an expensive item. Hydraulic service chairs are particularly expensive. For many service professionals, like barbers and hairstylists, the comfort and functionality of a service chair enhances the experience for their clients. As service chairs age, the comfort and functionality deteriorate with repetitive use. Moreover, undesired non-commercial use of service chairs hastens repairs and the need to reupholster the service chair. Thus, there is a need to prevent non-commercial use of service chairs.

According to an embodiment of the present invention, a chair cover includes a back panel configured to fit or cover a backside of a chair; a top or seat panel configured to fit or cover a front and seat area of the chair; and two side panels, each side panel configured to substantially cover an opposing side of the chair. A first fastener extends at least partially along a portion of the chair cover substantially corresponding to a top or headrest of the chair. Two second fasteners each extend at least partially along a portion of the chair cover substantially corresponding to an armrest of the chair.

According to another embodiment of the present invention, the panels of the chair cover comprise two to four pieces of fabric sewn or attached together. The back panel and the top panel may be a contiguous piece of fabric. The panels may comprise an elastic or flexible material.

According to another embodiment of the present invention, the first fastener and/or second fasteners each comprise a zipper, holes-and-buttons, a hook-and-loop fastener, snaps, or any combination thereof.

According to another embodiment of the present invention, the chair cover includes a video screen or display.

According to another embodiment of the present invention, the back panel and/or top panel includes a foldable portion configured to, in an unfolded position, a least partially cover a neck and/or face of a person.

According to another embodiment of the present invention, an article of clothing includes the chair cover according to any of the previous embodiments, wherein the first fastener is configured as a head opening for a wearer and the second fasteners are configured as arm openings for the wearer.

According to another embodiment of the present invention, the back panel and/or top panel of the article of clothing includes a foldable portion configured to, in an unfolded position, at least partially cover a neck and/or face of a wearer.

According to another embodiment of the present invention, the back panel and/or top panel includes a mask configured to at least partially cover a face and/or neck of the wearer.

DETAILED DESCRIPTION OF THE INVENTION

The present invention is directed to a chair cover for service chairs typically found in barbershops, salons, shoe shine parlors, tattoo parlors, dental offices, and the like. The chair cover may also be used as an article of clothing, for example, as a smock or protective garment.

In the detailed description, references to "one embodiment", "an embodiment", or "in embodiments" mean that the feature being referred to is included in at least one embodiment of the invention. Moreover, separate references to "one embodiment", "an embodiment", or "embodiments" do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

As used herein "substantially", "generally", and other words of degree are relative modifiers intended to indicate permissible variation from the characteristic so modified (e.g., +0.1%, +0.5%, +1.0%, +2%, +5%, +10%,+20%). It is not intended to be limited to the absolute value or characteristic which it modifies but rather possessing more of the physical or functional characteristic than its opposite, and preferably, approaching or approximating such a physical or functional characteristic.

Figure 1:
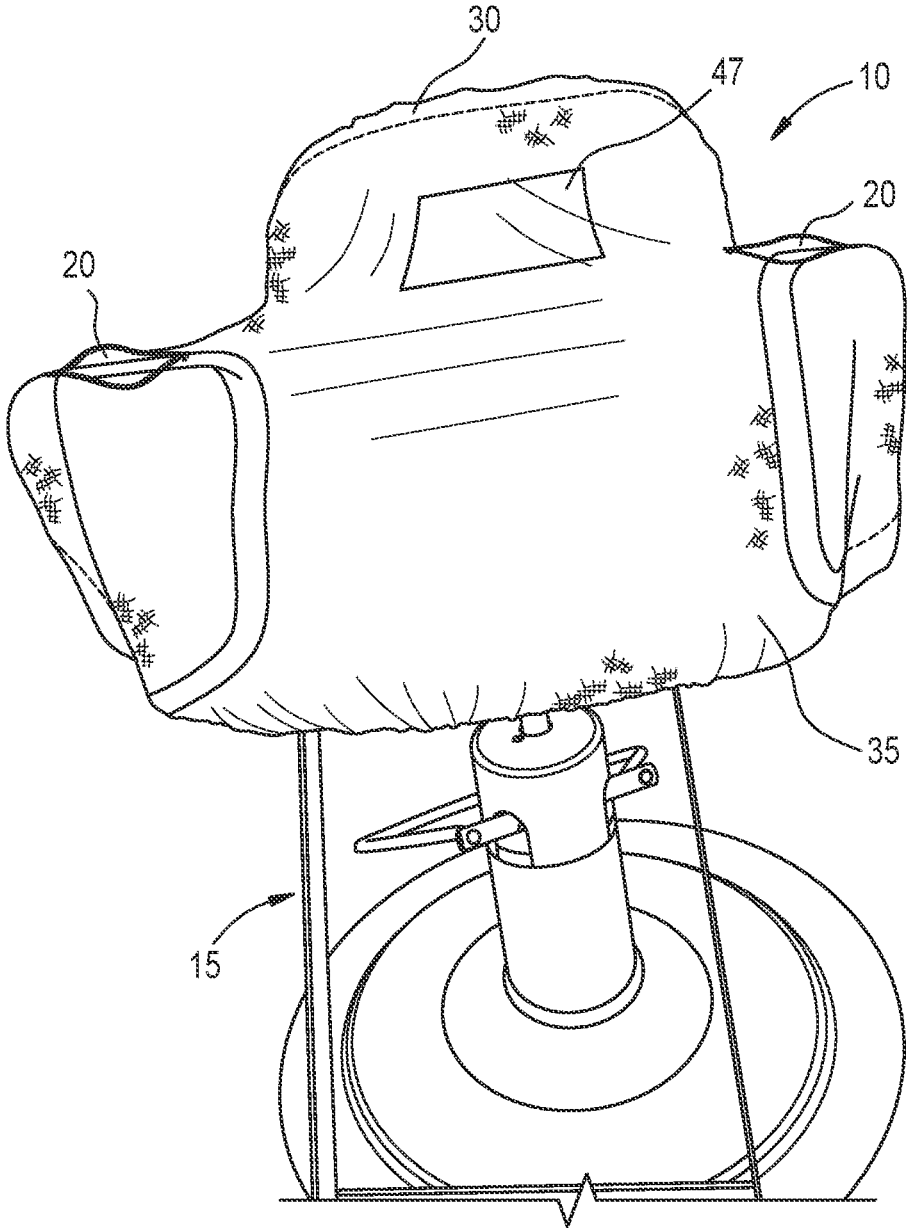
FIG. 1 is a front view of a service chair (i.e., a hydraulic barber chair) in which a chair cover according to an embodiment of the present invention is employed to at least partially cover the chair.

As shown in FIG. 1, a chair cover 10 according to an embodiment of the present invention at least partially covers a service chair 15 (e.g., a backside, front/backrest, seat, top, armrests,) in a secure and snug arrangement. In embodiments, the chair cover 10 is configured to substantially cover the parts of a service chair (e.g., a barber or salon chair) that a user would contact when seated in the chair. The chair cover has a degree of tautness that prevents someone from sitting in the chair. In embodiments, the chair cover does not have and/or does not require any separate loops, straps, belts, or buckles that attach to the chair or secure the chair cover to the chair. In embodiments, the chair cover does not have any rigid framing (e.g., metal or plastic wires or tubes).

Figure 3:
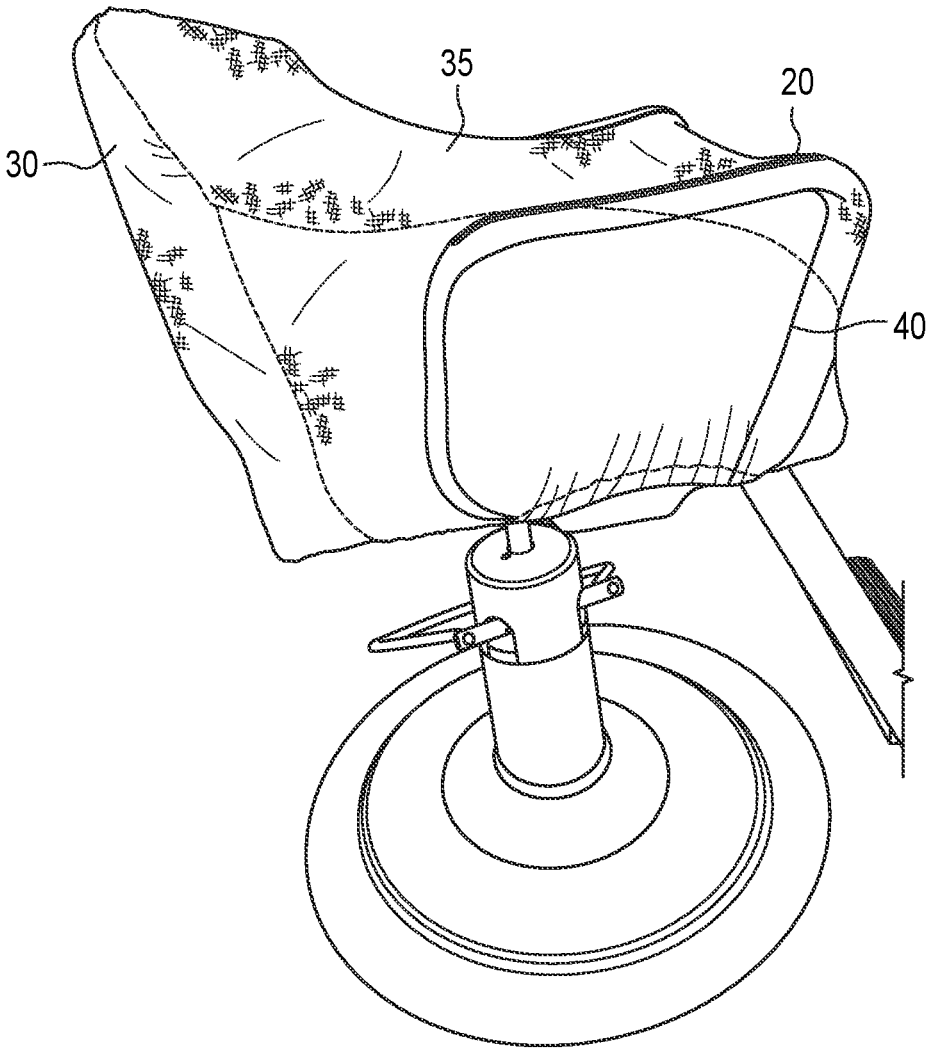
FIG. 3 is a side view of FIG. 1.
Figure 5:
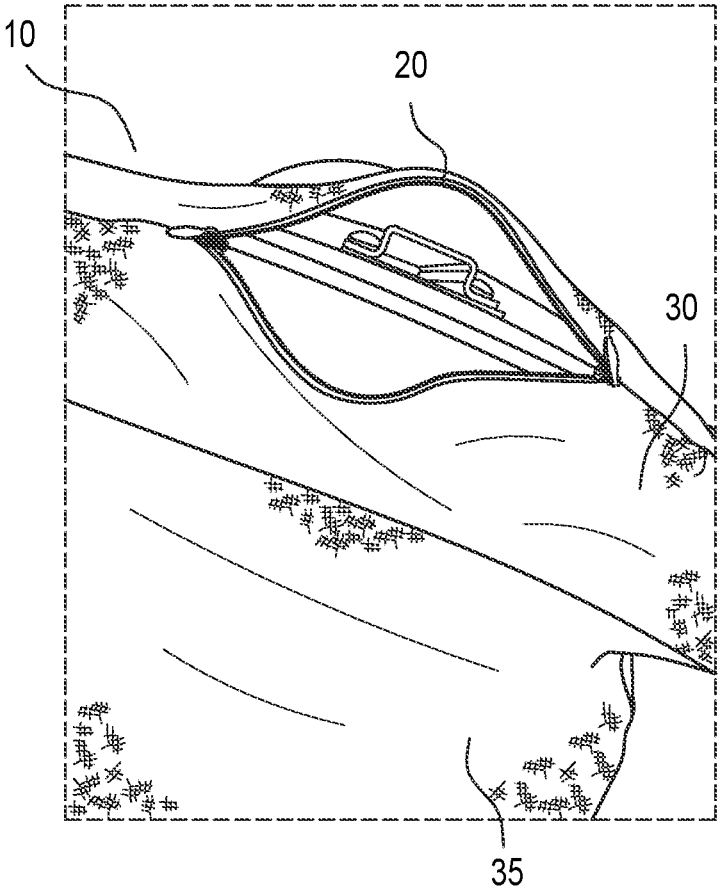
FIG. 5 is a top view of FIG. 1.

In specific embodiments, the chair cover 10 has at least one openable and closable fastener (e.g., zippers, holes-and-buttons, hook-and-loop or VELCRO®, or snaps). For example, two such fasteners 20 may be located on sections of the chair cover that at least partially cover armrests of the service chair (FIGS. 1 and 3). A fastener 20 may also be located on a section of the chair cover that at least partially covers a top or headrest of the chair (FIG. 5). In embodiments, the opening on the top of the chair cover may allow a headrest of the chair to remain stationary while a chair is covered. Thus, in embodiments, a headrest may remain attached while the chair is being covered. In specific embodiments, one or more fasteners may be located along part of a seam or edge between fabric panels that for the chair cover, as discussed below.

Figure 2:
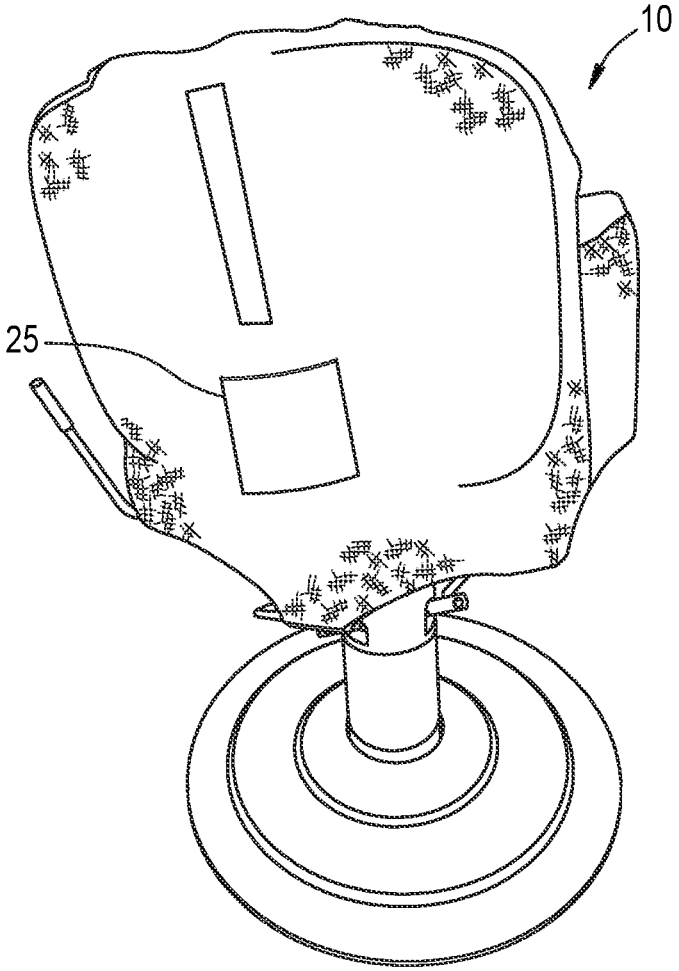
FIG. 2 is a back view of FIG. 1.

The chair cover may also have a pocket or pouch 25 (FIG. 2) located on a surface of the chair cover that covers the backside of the chair. In embodiments, the pocket or pouch 25 can hold supplies or pamphlets that a barber or stylist would like to easily access.

Figure 4:
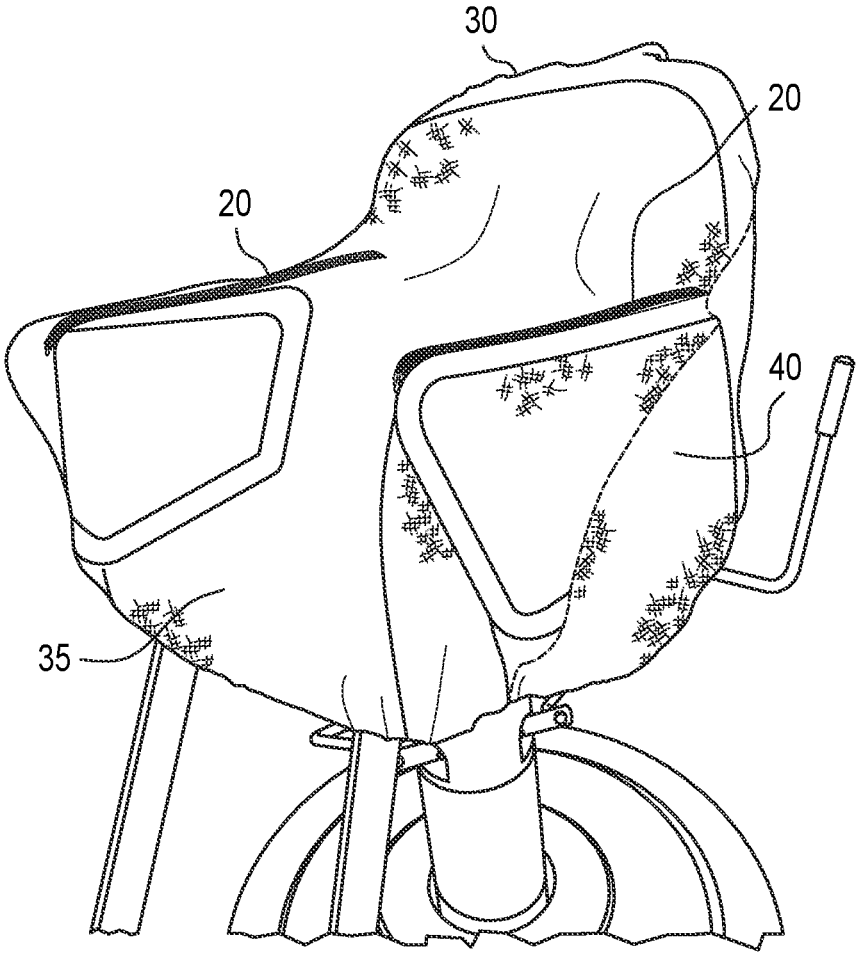
FIG. 4 is a side perspective view of FIG. 1.
Figure 14:
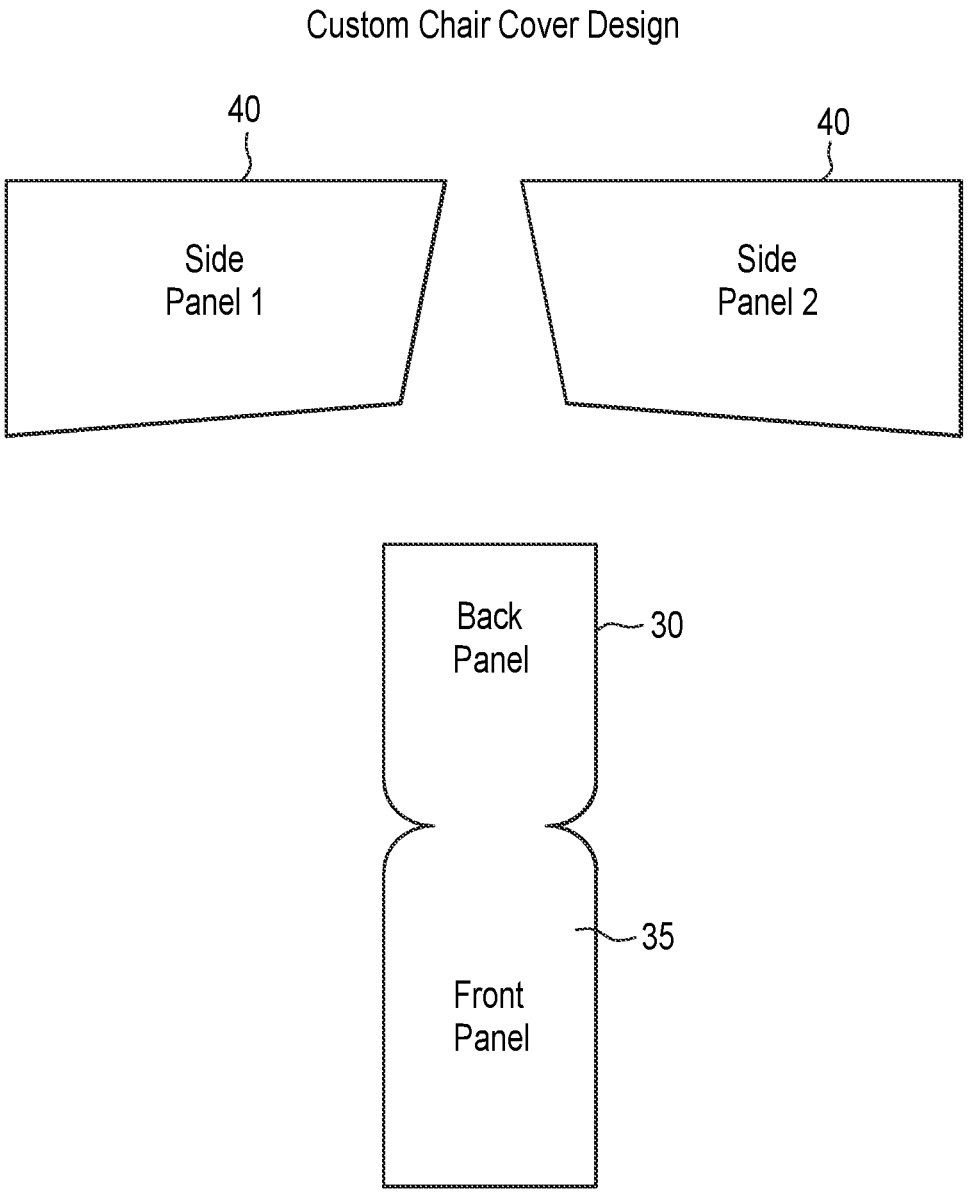
FIG. 14 is a schematic showing three separate pieces of fabric that can form a chair cover according to one embodiment of the present invention.

The chair cover 10 may be made from at least one piece of fabric, for example, two or more pieces of fabric sewn (stitched) or attached together. As shown in FIGS. 1 and 3-4, in an embodiment, the chair cover 10 may comprise the following fabric panels: a back panel 30 configured to fit or cover the backside of a service chair, a top or seat panel 35 configured to fit or cover the front and seat of the service chair, and two side panels 40 configured to substantially fit or cover the opposing sides of the service chair. As shown in FIG. 14, in one embodiment, the chair cover may be made from three pieces of fabric, with the back panel 30 and the top or front panel 35 being contiguous and two separate side panels 40.

In specific embodiments, the panels of the chair cover comprise a fabric that is flexible or elastic, for example, a polyester stretch fabric, a polyester-cotton blend, rubber, latex, lycra, neoprene, SPANDEX® or any combination thereof, so that the chair cover provides sufficient expansion without compromising tautness.

The dimensions of the chair cover may be chosen based upon the type of service chair to be covered. In specific embodiments, 1) a length of the back panel 30 may be from about 20-40 inches and a width may be about 22-30 inches; 2) a length of the top or seat panel 35 may be about 30-40 inches and a width may be about 20-30 inches; and 3) a length and/or width of each side panel 40 may be about 20-30 inches.

In specific embodiments, the panels 30, 35, 40 are attached or sewn together so that there is a bottom opening, thereby allowing the chair cover 10 to be easily slipped or pulled onto the service chair from above, that is, from the top of the service chair. The seams or edges of the panels may be guided over the top, back, seat area, and armrests of the service chair.

Figure 6:
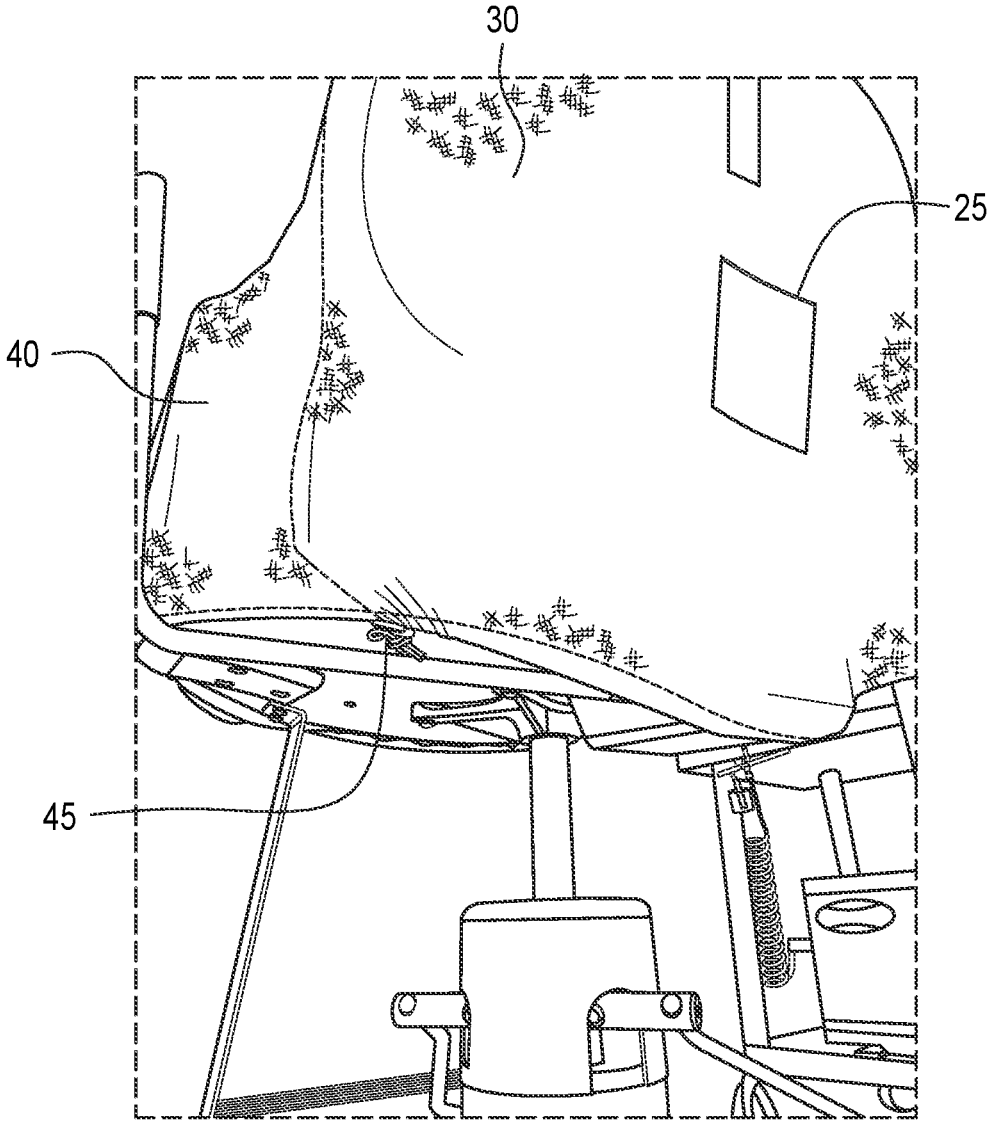
FIG. 6 is a bottom perspective view of FIG. 1 showing a drawstring.

In a specific embodiment, as shown in FIG. 6, the chair cover 10 may have a drawstring 45 located on or near a bottom of the chair cover, which allows a user to pull the chair cover 10 taut once it is deployed to cover a service chair. Otherwise, any noticeable slack in the elasticity or sagging in of the chair cover may invite unwelcomed sitting when the chair is not in use.

In a specific embodiment, as shown in FIG. 1, an exterior surface of at least one panel may have a screen or display 47 (e.g., a flexible video screen; liquid crystal (LCD) or light emitting diode (LED)) for displaying advertisements, entertainment, or other information. Thus, in a specific embodiment, a screen may display at least one of a time the chair will be open for use, the name of a client, and the client's estimated arrival or appointment time.

Figure 7:
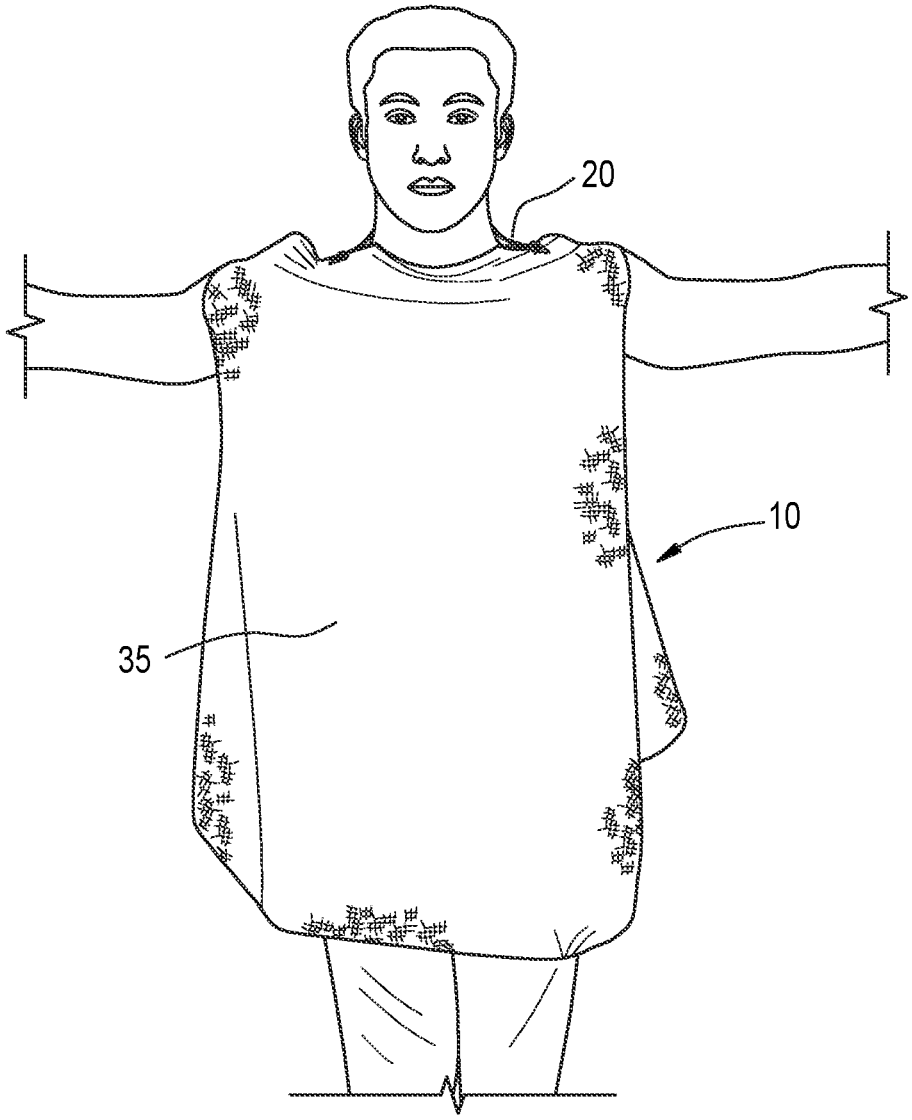
FIG. 7 is a front view of the chair cover according to an embodiment of the present invention in use as a smock or garment.
Figure 8:
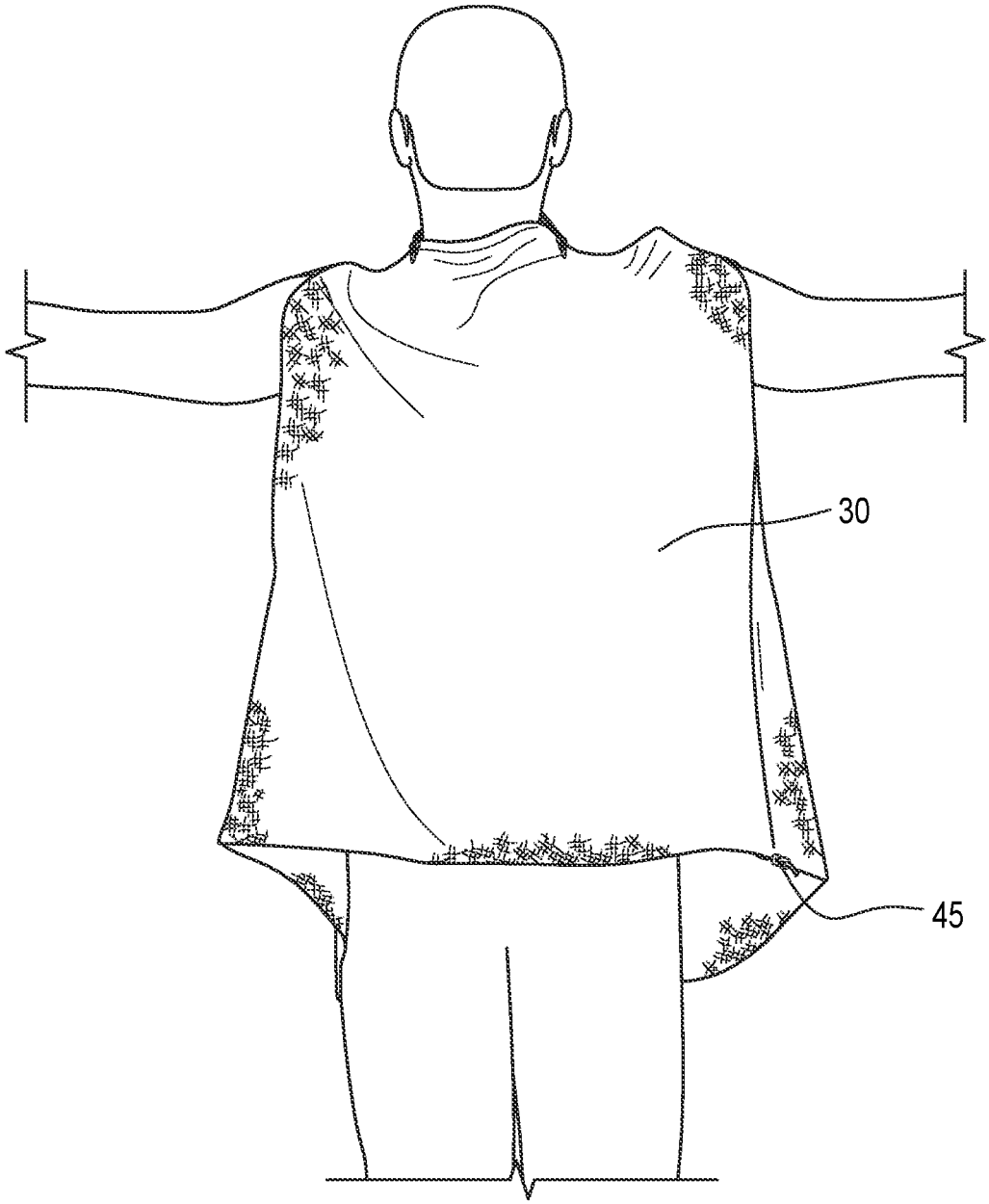
FIG. 8 is a back view of FIG. 7.
Figure 9:
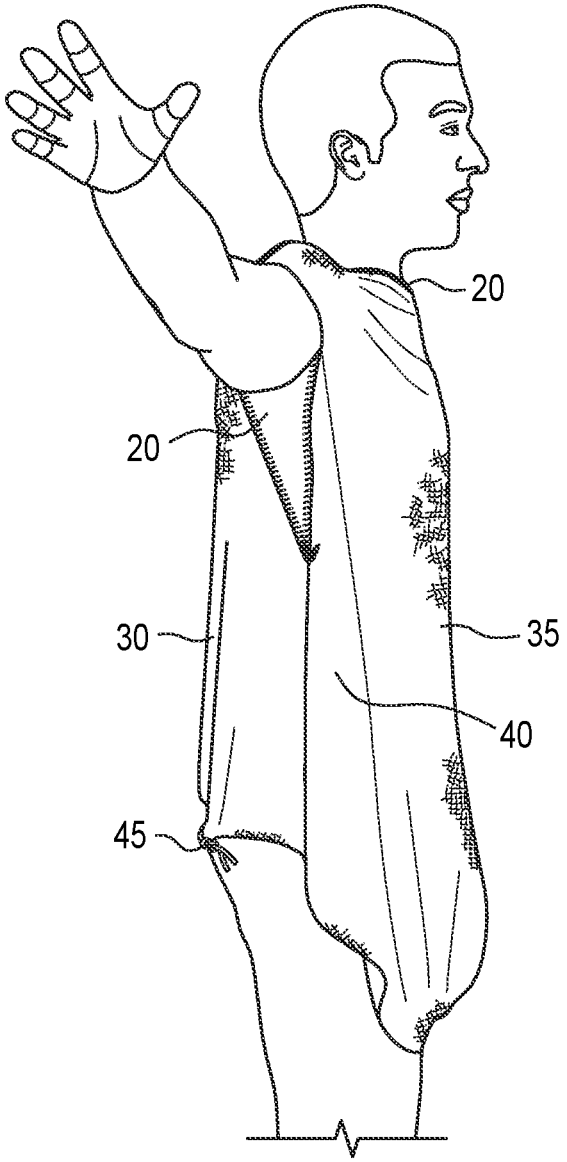
FIG. 9 is a side view of FIG. 7.
Figure 10:
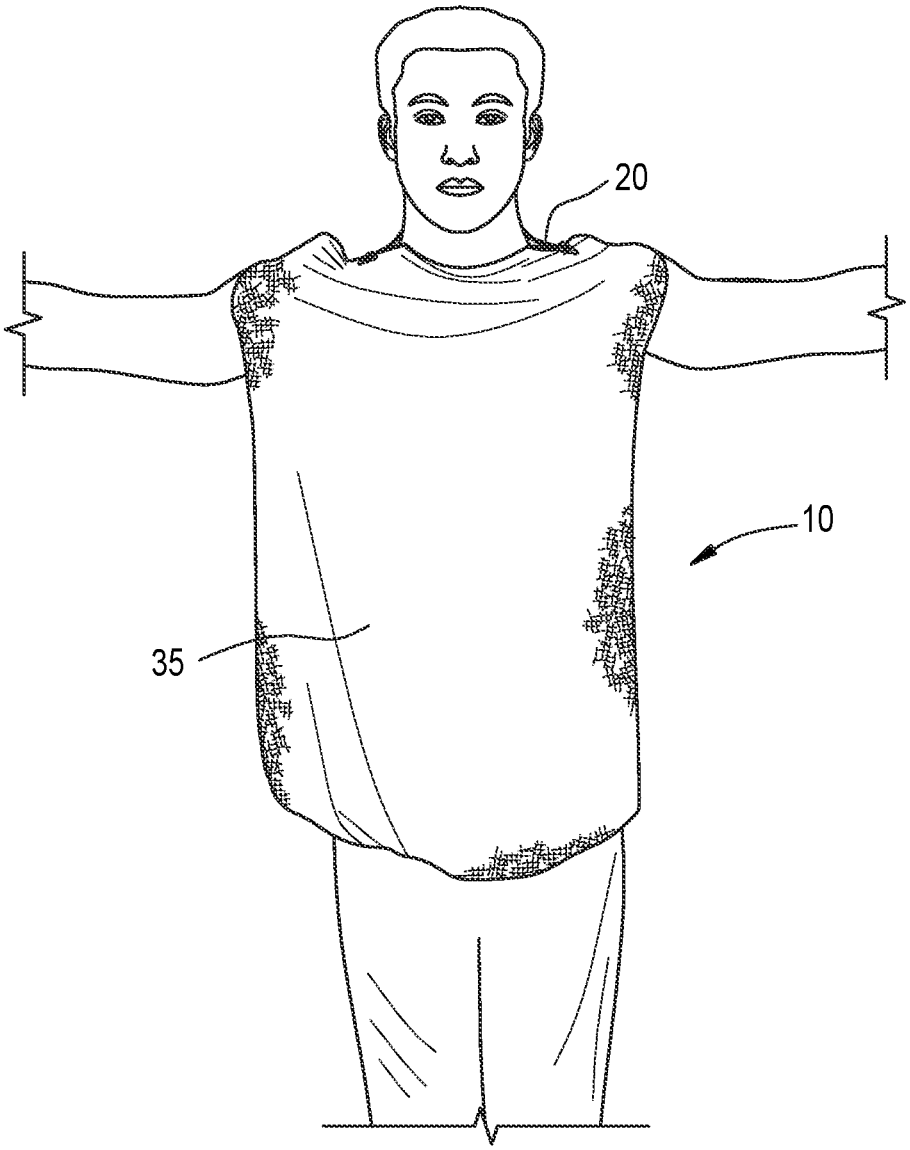
FIG. 10 is a front view of the chair cover according to another embodiment of the present invention in use as a smock or garment, in which a drawstring is tightened.
Figure 11:
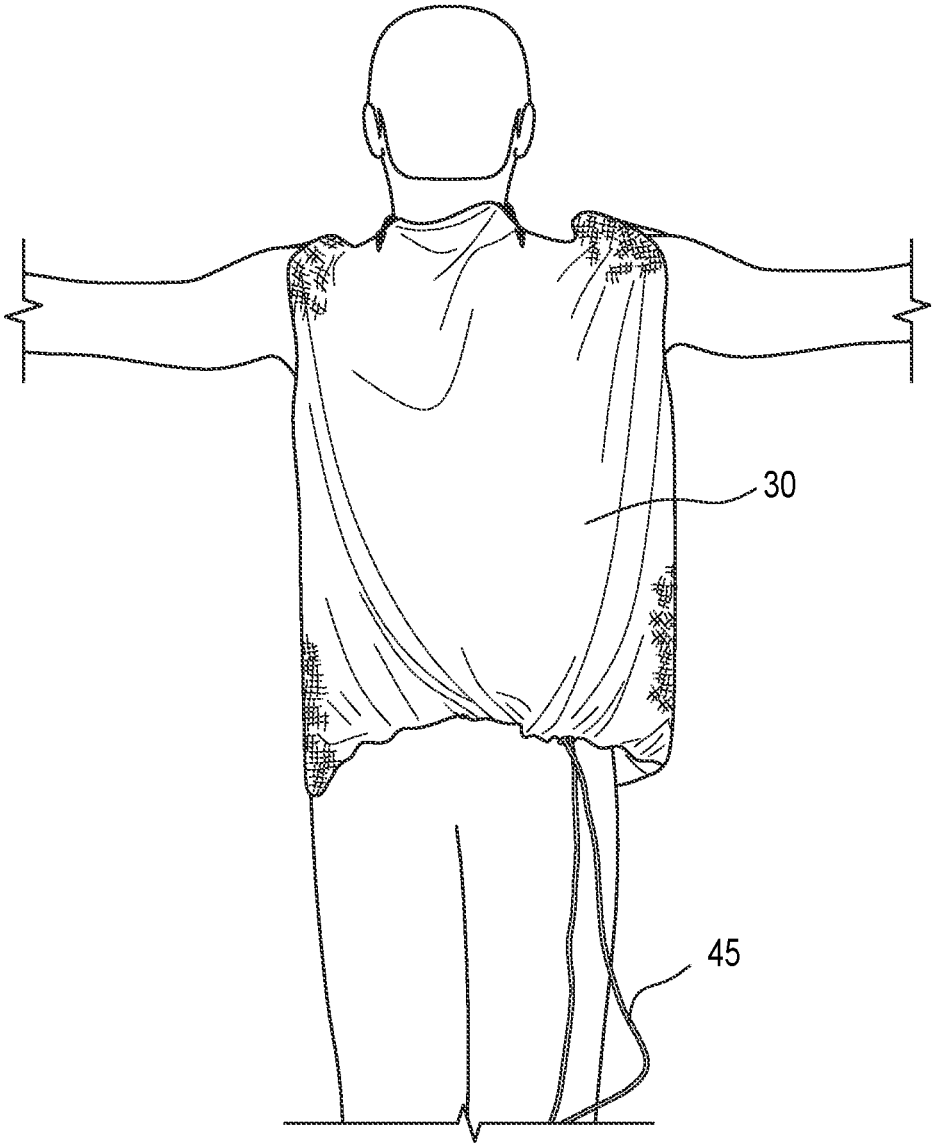
FIG. 11 is a back view of FIG. 10 showing the tightened drawstring.
Figure 12:
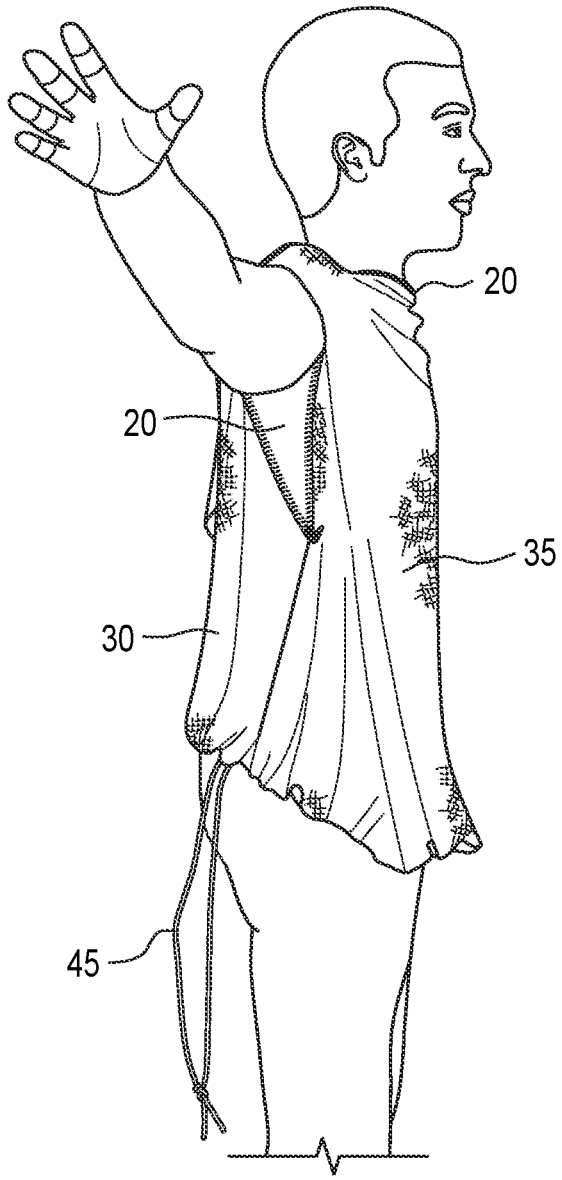
FIG. 12 is a side view of FIG. 11.

As shown in FIGS. 7-12, the chair cover 10 may also be used as an article of clothing, for example, as a smock or protective garment (FIGS. 7-9). In embodiments, openable and closable fasteners 20 on a top panel 35 and/or side panels 40 may form arm openings, and a fastener 20 on a back panel 30 and/or top panel 35 may form a head opening for a wearer. FIGS. 10-12 show the chair cover 10 in use as a smock or garment, in which a drawstring 45 is tightened.

Figure 13:
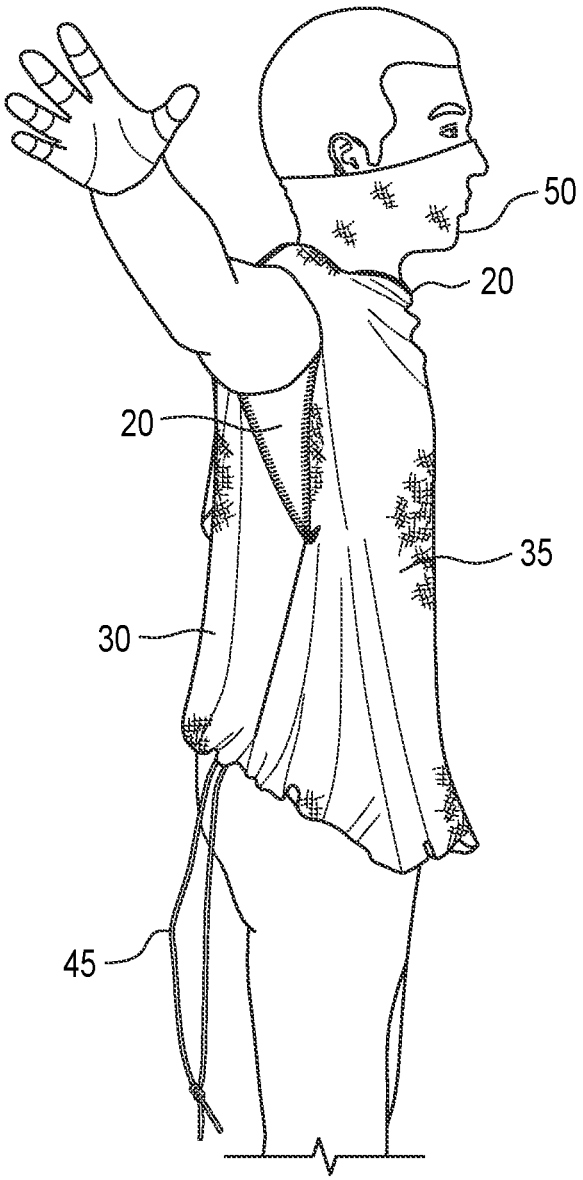
FIG. 13 is a view of FIG. 11 showing a face mask extending through a top opening of the smock or garment.

In a specific embodiment when using the chair cover as an article of clothing, as shown in FIG. 13, the back panel 30 and/or top panel 35 may include a mask 50, which may at least partially cover the face and/or neck of a wearer. The mask may be advantageous in times of flu, Covid, or when facial coverings are required by government regulation.

In embodiments, the mask 50 may comprise an elastic fabric ring or band (e.g., like a scrunchie). In one embodiment, the mask has a drawstring. In embodiments, the mask may be located on an inner surface of the chair cover near an openable and closable fastener 20 (e.g., zipper) so that it can be pulled through or unfolded through the fastener when in use.

In specific embodiments, the chair cover may have at least one additional panel or at least one interior and/or exterior layer on at least one panel that serves as a sanitary shield from inadvertent dispersals of airborne pathogens, blood, germs, and bodily fluids. For example, at least part of the underside of the chair cover may fixedly support a lining (e.g., latex) that prevents passage of such undesired materials.

Although only certain embodiments of the invention have been illustrated in the foregoing specification, it is understood by those skilled in the art that many modifications and embodiments of the invention will come to mind to which the invention pertains, having benefit of the teaching presented in the foregoing description and associated drawings.

It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the description of the invention.

What is claimed is:

1. A chair cover, comprising:

a back panel configured to fit or cover a backside of a chair;

a top or seat panel configured to fit or cover a front and seat area of the chair;

two side panels, each side panel configured to substantially cover an opposing side of the chair;

a first fastener extending at least partially along a portion of the chair cover corresponding to a top or headrest of the chair; and two second fasteners, each second fastener extending at least partially along a portion of the chair cover corresponding to an armrest of the chair;

wherein each panel comprises a flexible or elastic fabric and the chair cover is configured to prevent a person from sitting in the chair.

2. The chair cover of claim 1, wherein the back panel, top or seat panel, and side panels consist of two to four pieces of fabric sewn or attached together.

3. The chair cover of claim 1, wherein the back panel and the top or seat panel are a contiguous piece of fabric.

4. The chair cover of claim 1, wherein the back panel further comprises a pocket or pouch on an outer surface.

5. The chair cover of claim 1, further comprising a drawstring for tightening a bottom of the chair cover.

6. The chair cover of claim 1, wherein the first fastener comprises a zipper, holes-and-buttons, a hook-and-loop fastener, or snaps.

7. The chair cover of claim 1, wherein each second fastener comprises a zipper, holes-and-buttons, a hook-and-loop fastener, or snaps.

8. The chair cover of claim 1, wherein the flexible or elastic fabric comprises a polyester stretch fabric, a polyester-cotton blend, rubber, latex, lycra, neoprene, or any combination thereof.

9. The chair cover of claim 1, further comprising a video screen or display.

10. The chair cover of claim 1, further comprising a flexible video screen, a liquid crystal (LCD) display or a light emitting diode (LED).

11. The chair cover of claim 1, wherein the back and/or top panel further comprises a mask configured to at least partially cover the face and/or neck of a person.

12. The chair cover of claim 1, wherein at least one panel has a layer on a surface thereof comprising an antibacterial material.

13. An article of clothing comprising the chair cover of claim 1, wherein the first fastener is configured as a head opening for a wearer and the two second fasteners are configured as arm openings for a wearer.

14. The article of clothing of claim 13, wherein the back panel and/or top panel comprises a mask configured to at least partially cover a face and/or neck of the wearer.

15. The article of clothing of claim 14, wherein the mask comprises an elastic fabric band or ring.

16. A service chair comprising the chair cover of claim 1, wherein the chair is a hydraulic chair and the chair cover covers the backside, front and seat area, and opposing sides of the service chair and has a degree of tautness to prevent a person from sitting in the chair.

17. The service chair of claim 16, wherein the service chair comprises a barber chair or a salon chair.

18. The service chair of claim 17, wherein:

a length of the back panel is about 20-40 inches, a length of the top or seat panel is about 30-40 inches, and a length of each side panel is about 20-30 inches.

19. A method comprising covering a hydraulic service chair with the chair cover of claim 1.

20. The chair cover of claim 1, wherein the chair cover does not have any loops, straps, belts, or buckles that attach to the chair.

21. A chair cover, consisting of:

a back panel configured to cover a backside of a chair;

a top panel configured to cover a front and seat area of the chair;

two side panels, each side panel configured to substantially cover an opposing side of the chair;

at least one first fastener located partially along a seam between the back panel and the top panel;

at least two second fasteners, each second fastener located partially along a seam between a side panel and the top panel; and an optional drawstring located on or near a bottom of the chair cover, wherein the panels comprise an elastic or flexible material and are sewn or attached together, and wherein the chair cover has a degree of tautness that prevents a person from sitting in the chair.

* * * * *